US007658442B1

(12) United States Patent
Whiteside et al.

(10) Patent No.: US 7,658,442 B1
(45) Date of Patent: Feb. 9, 2010

(54) MOBILE CHAIR WITH STORAGE CAPABILITIES

(75) Inventors: Kirt E. Whiteside, Marion, OH (US); Terry L. Whiteside, Delaware, OH (US); Kristin C. Mays, Delaware, OH (US); Don Brimhall, Delaware, OH (US); George Wolber, Ada, OH (US); Shane Obitts, Elyria, OH (US)

(73) Assignee: Whiteside Mfg. Co., Delaware, OH (US)

( * ) Notice: Subject to any disclaimer, the term of this patent is extended or adjusted under 35 U.S.C. 154(b) by 99 days.

(21) Appl. No.: 11/352,975

(22) Filed: Feb. 13, 2006

(51) Int. Cl.
*A47C 7/62* (2006.01)

(52) U.S. Cl. ..... 297/188.11; 297/188.01

(58) Field of Classification Search ..... 297/83, 297/123.93, 123, 232, 284.6, 295, 188.11; 5/58; 312/270.3, 334.7, 334.25, 334.24, 312/334.23, 246, 334.1, 330.1; 108/26
See application file for complete search history.

(56) References Cited

U.S. PATENT DOCUMENTS

| | | | | | |
|---|---|---|---|---|---|
| 374,997 | A | * | 12/1887 | Remaly | 297/449.1 |
| 2,215,665 | A | * | 9/1940 | Hedlund | 62/286 |
| 2,386,757 | A | * | 10/1945 | Straubel | 312/334.13 |
| 3,806,220 | A | * | 4/1974 | Payne | 312/330.1 |
| 4,061,395 | A | * | 12/1977 | Boole | 297/188.11 |
| 4,397,374 | A | | 8/1983 | Rumage et al. | 182/129 |
| 4,624,502 | A | * | 11/1986 | Boole | 297/188.11 |
| D292,454 | S | | 10/1987 | Rykken | D6/335 |
| 4,925,245 | A | * | 5/1990 | Pendleton et al. | 297/440.1 |
| 4,944,566 | A | * | 7/1990 | Carper | 312/311 |
| 5,188,442 | A | * | 2/1993 | Harty et al. | 297/188.11 |
| D353,058 | S | | 12/1994 | Dallas | D6/336 |
| 5,439,285 | A | * | 8/1995 | Lautenschlager | 312/348.1 |
| 5,451,068 | A | * | 9/1995 | Shockley | 280/32.6 |
| 5,462,349 | A | * | 10/1995 | Grabher | 312/348.1 |
| RE35,732 | E | | 2/1998 | Shockley | 280/32.6 |
| D399,626 | S | | 10/1998 | Taylor | D34/23 |
| 5,887,878 | A | * | 3/1999 | Tisbo et al. | 280/47.19 |
| D410,128 | S | | 5/1999 | Dallas et al. | D34/23 |
| 6,010,187 | A | * | 1/2000 | Dallas et al. | 297/188.08 |
| 6,056,378 | A | * | 5/2000 | Semon et al. | 312/246 |
| 6,123,392 | A | | 9/2000 | Alfred et al. | 297/466 |
| 6,199,877 | B1 | | 3/2001 | Shockley | 280/32.6 |
| D456,647 | S | | 5/2002 | Whiteside et al. | D6/498 |
| 6,398,234 | B1 | * | 6/2002 | Brown | 280/32.6 |
| D461,964 | S | | 8/2002 | Chen | D6/335 |
| 6,702,065 | B2 | | 3/2004 | Ehnes | 182/150 |
| 6,733,073 | B2 | * | 5/2004 | Whiteside et al. | 297/188.08 |
| 6,758,519 | B2 | * | 7/2004 | Harvey | 297/188.08 |
| D511,416 | S | | 11/2005 | Obitts et al. | D6/336 |
| 6,969,077 | B2 | * | 11/2005 | Liu | 280/30 |
| D579,679 | S | * | 11/2008 | Qian et al. | D6/349 |

(Continued)

*Primary Examiner*—David Dunn
*Assistant Examiner*—James Alex
(74) *Attorney, Agent, or Firm*—Renner, Kenner, Greive, Bobak, Taylor & Weber

(57) ABSTRACT

A chair (10) includes a frame (11) which carries a seat (29). Opposed track assemblies (30) depend downwardly from branches (12, 13) of the frame (11) and slidably carry a drawer (40). The drawer (40) is thereby positioned below the branches (12, 13) and below the seat (29) by a substantial distance so that items in the drawer which extend above the upper surface of the drawer do not engage the seat (25). Branches (14, 15) of the frame (11) may carry a tray (20).

16 Claims, 3 Drawing Sheets

U.S. PATENT DOCUMENTS 7,481,438 B2 * 1/2009 Hernandez ..... 280/32.6
D586,132 S * 2/2009 Liuhong et al. ..... D6/335
2005/0225131 A1 * 10/2005 Hynes ..... 297/188.11
2007/0063626 A1 * 3/2007 Scott ..... 312/334.7

* cited by examiner

MOBILE CHAIR WITH STORAGE CAPABILITIES

TECHNICAL FIELD

This invention relates to a mobile chair such as that used by mechanics or the like. More specifically, this invention relates to such a chair which has a drawer and a tray positioned to conveniently hold tools or other items needed by the mechanics.

BACKGROUND ART

Chairs which consist of a seat mounted on a frame and rendered mobile by casters or the like are well known in the art. Such chairs are often utilized by mechanics or other workmen who can thereby work in a sitting position while at the same time have the mobility to move about without the necessity of having to stand up.

Since the user of such chairs often needs ready access to tools or other supplies, it is desirable to provide these chairs with some type of storage capability. To that end, one known prior art device utilizes a drawer positioned directly under the seat and movable on the frame which carries the seat. While such does provide the chair with storage capabilities, the positioning of the drawer presents other problems. For example, when the drawer is open, items in the drawer are often stacked or otherwise positioned unevenly above the profile of the drawer. As such, either the drawer cannot be easily closed, or, upon closing, items can be knocked to the floor. Additionally, items which may be jammed in a closed drawer can often prevent the drawer from being opened easily.

Therefore, the need exists for a mobile chair with convenient and easily accessible storage capabilities.

DISCLOSURE OF THE INVENTION

It is therefore an object of the present invention to provide a chair with storage capabilities.

It is another object of the present invention to provide a chair, as above, with a drawer which is positioned so that it can be easily opened or closed even when overflowing with items.

It is a further object of the present invention to provide a chair, as above, with a secondary storage medium to hold larger items.

It is an additional object of the present invention to render the chair, as above, mobile.

These and other objects of the present invention, as well as the advantages thereof over existing prior art forms, which will become apparent from the description to follow, are accomplished by the improvements hereinafter described and claimed.

In general, a chair made in accordance with the present invention includes a frame having opposed branches which carry a seat, the seat having a bottom surface. A track assembly is carried by each branch of the frame, and a drawer is moveable on the track assemblies. The drawer has an upper surface which is spaced from the bottom surface of the seat so that items in the drawer can extend above its upper surface and not engage the seat.

In accordance with another aspect of the present invention, a chair includes a frame having opposed branches. A seat is carried above the branches and a track assembly depends downwardly from each of the branches. A drawer having an upper surface is moveable on the track assemblies such that the upper surface of the drawer is below the branches of the frame to provide a clearance between the drawer and the seat.

A preferred exemplary chair according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
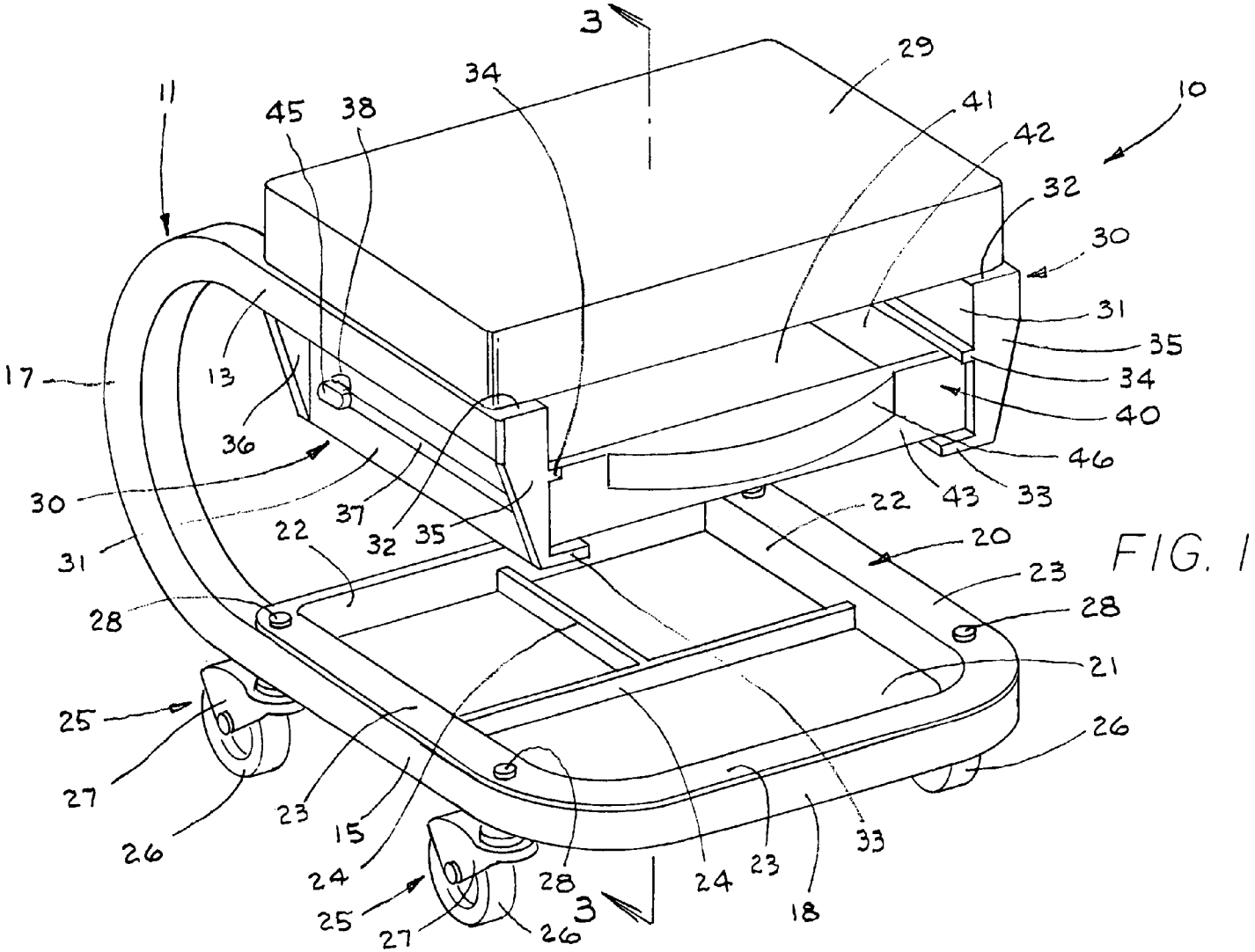
FIG. 1 is perspective view of a chair made in accordance with the present invention.

A chair made in accordance with the present invention is generally indicated by the numeral 10 and includes a metallic frame generally indicated by the numeral 11. Frame 11 is generally in the form of square tubing configured as two U's having one of their branches interconnected. That is, frame 11 includes opposed and spaced upper branches 12, 13 and opposed and spaced lower branches 14, 15. The rear end of branch 12 is interconnected to the rear of its adjacent lower branch 14 by a vertically oriented arcuate portion 16 thereby completing the U-shape. The rear end of branch 13 is likewise connected to the rear of its adjacent lower branch 15 by a vertically oriented arcuate portion 17 thereby completing the U-shape. The front of lower branches 14, 15 are interconnected by a horizontally oriented frame portion 18. Thus, frame 11 consists of a continuous tubing starting at the top with upper branch 12, continuing through arcuate portion 16 to lower branch 14 which continues through frame portion 18 to the other lower branch 15 which is interconnected to the other arcuate portion 17 that extends to the other upper branch 13.

Frame 11 carries a tray generally indicated by the numeral 20. Tray 20 may be a plastic member and includes a bottom surface 21 having side walls 22 extending upwardly therefrom. Three of the side walls 22 are shown as having a skirt 23 extending horizontally from the tops thereof. Drawer dividing ribs 24 may be provided on bottom surface 21 to divide tray 20 into compartments. Tray 20 may thereby carry large items or tools which may be needed by the user of chair 10.

Chair 10 may be rendered mobile by a plurality of caster assemblies generally indicated by the numeral 25. As is known in the art, each caster assembly 25 includes a wheel 26 rotatably carried by a horn 27 which can swivel on a caster stem 28. Caster assemblies 25 are carried by frame 11 generally near each end of lower branches 14, 15. As such, stems 28 may also pass through the skirt 23 of tray 20 so that tray 20 can be attached to frame 11. Alternatively, skirt 23 of tray 20 may merely rest on branches 14, 15 and portion 18 of frame 11, and, as such, tray 20 could be removed from frame 11 and chair 10.

Figure 2:
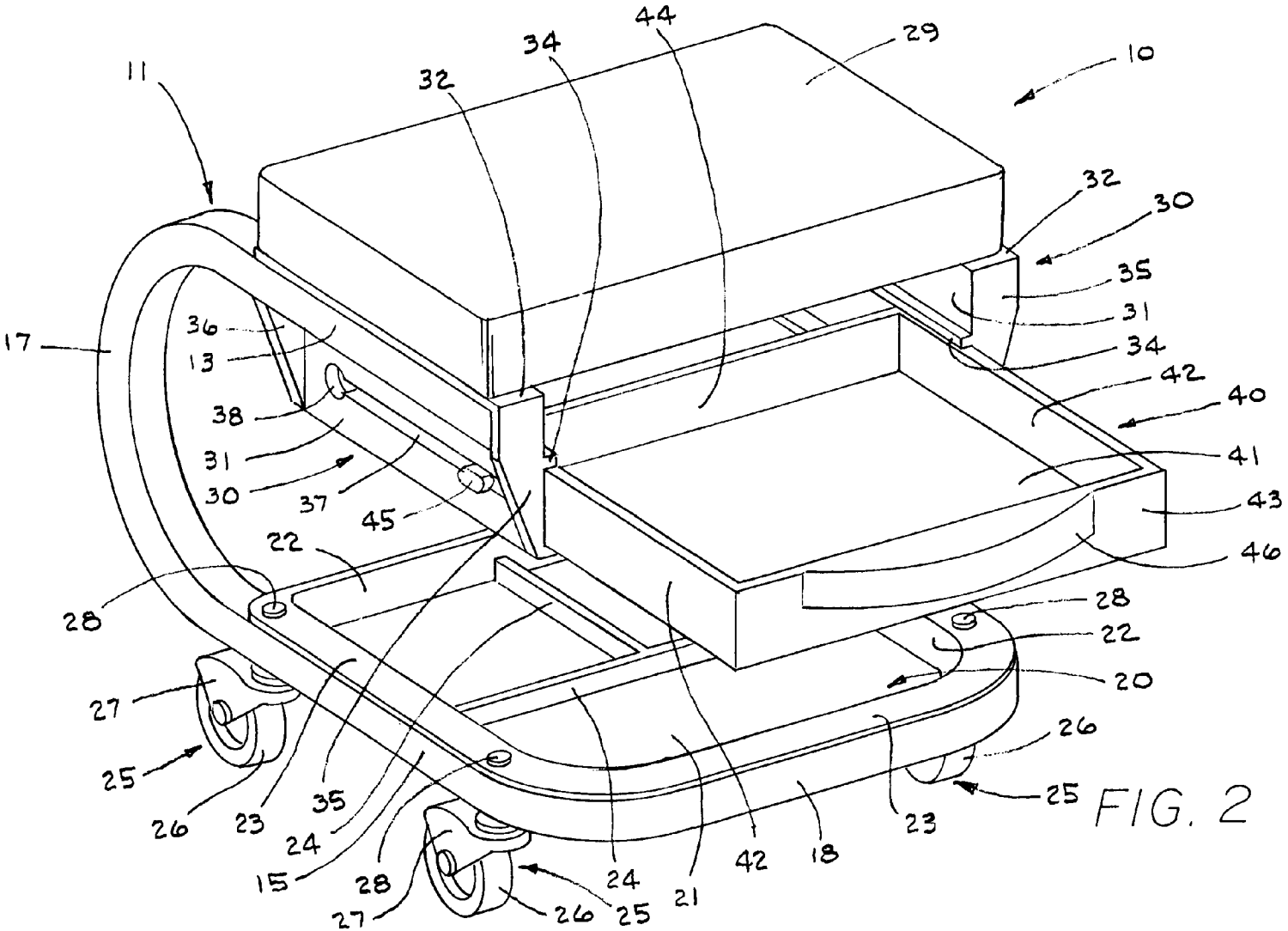
FIG. 2 is a perspective view like FIG. 1 but showing the drawer of the chair in an extended position.

Frame 11, and specifically upper branches 12, 13 thereof, carry a seat 19 shown to be in the form of a pad for the user to sit upon. It should be evident that seat 29 could also be in the form of a small chair having a backrest. Branches 12 and 13 each also carry a track assembly generally indicated by the numeral 30. Each track assembly 30 depends downwardly from frame branches 12, 13 and includes a main vertically extending body portion 31 having a skirt 32 extending generally horizontally from the top end thereof in one direction, and a ledge 33 extending generally horizontally from the bottom end of body portion 36 in the other direction. Thus, track assembly 30 is overall Z-shaped in section. A skirt 32 of a track assembly 30 is positioned between the top surface of each branch 12, 13 and seat 29. A small rib 34 extends outwardly from body portion 31 generally centrally between skirt 32 and ledge 33 and in the same direction as ledge 33. Each track assembly 30 also includes opposed front and rear gusset ends 35, 36 which provide additional strength to track assemblies 30. Each body portion 31 is provided with a horizontally extending slot track 37 having a circular end 38 (FIG. 2).

Figure 3:
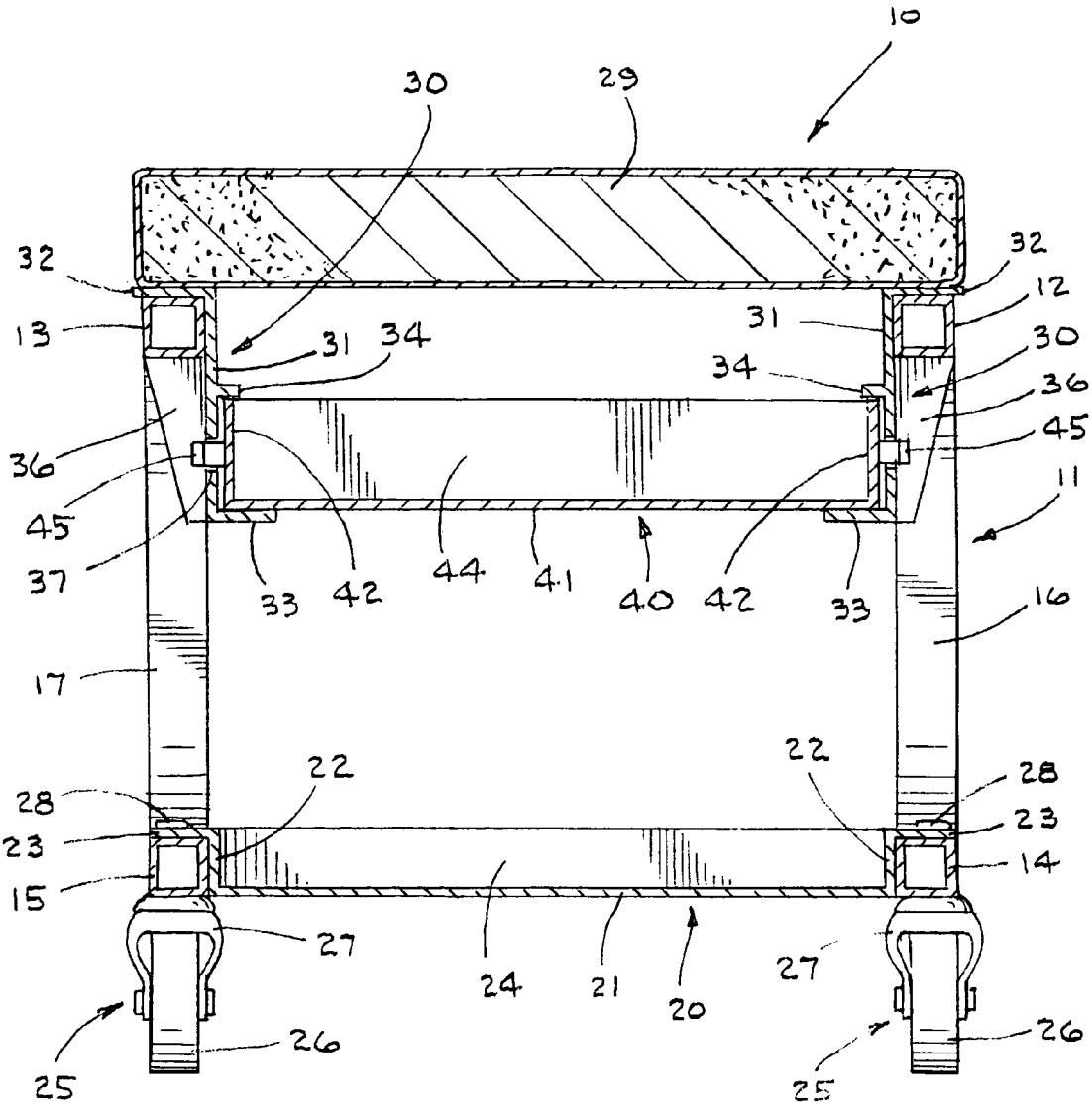
FIG. 3 is a sectional view taken substantially along line 3-3 of FIG. 1.

Track assemblies 30 carry a drawer generally indicated by the numeral 40. Drawer 40 includes a bottom surface 41, opposed side walls 42 extending upwardly from the bottom surface 41, and opposed front and rear walls 43, 44 extending upwardly from bottom surface 41 between side walls 42. Each side wall 42 has a lug 45 extending outwardly therefrom near rear wall 44. Each lug 45 is received in a slot track 37 of track assemblies 30. To install or remove drawer 40 from track assemblies 30, lugs 45 may be received through circular ends 38 of each slot track 37. Thus, drawer 30 may be moved along track 37 with each side wall 42 being positioned between rib 34 and ledge 33. In order to facilitate the movement of drawer 40, front wall 43 thereof may be provided with a handle 46. As shown in FIG. 1, when drawer 30 is in the closed position, handle 46 extends beyond the top plan profile of seat pad 29 for ease of grasping. Moreover, as best seen in FIG. 3, the upper surface of drawer 30 is spaced from the bottom surface of the seat pad 29 a substantial distance, that is, approximately the height of walls 42, 43 and 44. The upper surface of drawer 30 is also spaced from the bottom surface of branches 12, 13 of frame 11 and is thereby positioned below frame 11. As such, items stored in drawer 30 can readily extend well above the top of walls 42, 43, 44 without interference with seat pad 29 when drawer 30 is being opened and closed.

It should thus be evident that a chair constructed as described herein accomplishes the objects of the present invention and otherwise substantially improves the art.

What is claimed is:

1. A chair comprising a frame having opposed branches extending lengthwise in a generally horizontal direction, a track assembly attached to each said branch and including a body portion with a skirt extending from one end of said body portion, a ledge extending from the other end of said body portion, and a rib extending from said body portion and spaced from said ledge, said rib being spaced below said branch, said skirt being interposed between one of said branches and said seat so that said body portions extend downwardly from said branches, a seat carried by said branches and having a bottom surface directly adjacent said track assemblies, and a drawer positioned between said rib and said ledge of each said track assembly and being moveable on said track assemblies and having an upper surface, the upper surface of said drawer being spaced from the bottom surface of said seat so that items in said drawer can extend above the upper surface and not engage said seat.

2. The chair of claim 1, each said body portion having a slot track therein, said drawer having lugs received in said slot tracks.

3. A chair comprising a frame having opposed branches, a track assembly attached to each said branch and including a body portion with a skirt extending from one end of said body portion, a ledge extending from the other end of said body portion, and a rib extending from said body portion and spaced from said ledge, said rib being spaced below said branch, said skirt being interposed between one of said branches and said seat so that said body portions extend downwardly from said branches, a seat carried by said branches and having a bottom surface directly adjacent said track assemblies, a drawer positioned between said rib and said ledge of each said track assembly and being moveable on said track assemblies and having an upper surface, the upper surface of said drawer being spaced from the bottom surface of said seat so that items in said drawer can extend above the upper surface and not engage said seat, and a handle on said drawer, said drawer being moveable to a closed position under said seat, said handle extending beyond said seat when said drawer is in said closed position.

4. The chair of claim 1, said frame having a second set of opposed branches, each said branch of said second set being connected to one said branch of said generally horizontally extending branches.

5. The chair of claim 4 further comprising a tray carried by said second set of branches.

6. The chair of claim 5 further comprising caster assemblies carried by said second set of branches to render the chair mobile.

7. The chair of claim 6 wherein said tray includes a skirt resting on said second set of branches.

8. The chair of claim 7 further comprising means to attach said caster assemblies and said skirt to said second set of branches.

9. A chair comprising a frame having opposed branches extending lengthwise in a generally horizontal direction, a track assembly attached to each said branch and including a body portion with a skirt extending from one end of said body portion, a ledge extending from the other end of said body portion, and a rib extending from said body portion and spaced from said ledge, said rib being spaced below said branch, said skirt being interposed between one of said branches and said seat so that said body portions extend downwardly from said branches, a seat carried above said branches and directly adjacent said track assemblies, each said track assembly depending downwardly from each said branch, and a drawer positioned between said rib and said ledge of each said track assembly and being moveable on said track assemblies and having an upper surface, the upper surface of said drawer being below said branches to provide a clearance between said drawer and said seat.

10. The chair of claim 9 wherein the upper surface of the drawer is spaced from said seat by a substantial distance.

11. The chair of claim 10 wherein said drawer has a height and said substantial distance is approximately the same as said height.

12. The chair of claim 9, each said body portion having a slot track therein, said drawer having lugs received in said slot tracks.

13. The chair of claim 9 further comprising a handle on said drawer, said drawer being moveable to a closed position under said seat, said handle extending beyond said seat when said drawer is in said closed position.

14. The chair of claim 9 further comprising a tray carried by said frame.

15. The chair of claim 14 further comprising caster assemblies carried by said frame to render the chair mobile.

16. The chair of claim 15 further comprising means to attach said caster assemblies and said tray to said frame.

* * * * *